US006539964B1

(12) United States Patent
Ko

(10) Patent No.: US 6,539,964 B1
(45) Date of Patent: Apr. 1, 2003

(54) POSITIONING STRUCTURE OF A MANUAL FOLDED UMBRELLA

(76) Inventor: Chin-Sung Ko, No. 38, Din Nan Road, Homei, Changhua (TW)

( * ) Notice: Subject to any disclaimer, the term of this patent is extended or adjusted under 35 U.S.C. 154(b) by 9 days.

(21) Appl. No.: 09/965,840

(22) Filed: Oct. 1, 2001

(51) Int. Cl.[7] ..... A45B 25/08; A45B 25/10

(52) U.S. Cl. ..... 135/28; 135/39; 135/41; 135/38

(58) Field of Search ..... 135/28, 38–41

(56) References Cited

U.S. PATENT DOCUMENTS 5,732,725 A * 3/1998 Ko ..... 135/28
5,740,824 A * 4/1998 Tang ..... 135/28
5,911,233 A * 6/1999 Wu ..... 135/28
5,964,235 A * 10/1999 Wang ..... 135/28
6,006,771 A * 12/1999 Wu ..... 135/41
6,131,590 A * 10/2000 Kuang et al. ..... 135/28
6,382,222 B1 * 5/2002 Ko ..... 135/41
2002/0179130 A1 * 12/2002 Ko ..... 135/39

FOREIGN PATENT DOCUMENTS

FR 879271 * 2/1943 ..... 135/28

* cited by examiner

*Primary Examiner*—Robert Canfield
(74) *Attorney, Agent, or Firm*—Rosenberg, Klein & Lee

(57) ABSTRACT

The present invention relates to a positioning structure of a manual folded umbrella, which includes an engaging hook being connected under an upper joint and being formed with an inward step at bottom end, and a runner having an elastic connector with a lower projection at a side. The inward step can engage with the connector for positioning the umbrella in opening state and the projection can be directly pressed to release the runner from the engaging hook for closing the umbrella easily and safely.

1 Claim, 5 Drawing Sheets

POSITIONING STRUCTURE OF A MANUAL FOLDED UMBRELLA

BACKGROUND OF THE INVENTION

The present invention relates to a positioning structure of a manual folded umbrella, which can be conveniently operated in secure.

A conventional manual folded umbrella, as shown in FIG. 1, is provided with an elastic hook (11) under an upper joint (1), which has its tail end (12) extending outward inclinedly. A runner (2) is formed with a side slot for engaging with the tail end (12) of the elastic hook (11) when the umbrella is opened and is then positioned. The said prior structure is used for the umbrella having a shaft (3) with small upper tube and large lower tube. The elastic hook (11) must be enough length for accompanying with frames of the umbrella. So the elastic hook (11) is easily broken. Furthermore, one must directly push the tail end (12) by his finger to release the runner (2) for closing the umbrella. It is very possible to be hurt during this operation.

Accordingly, the primary object of the invention is to provide a positioning structure of a manual folded umbrella with an invented engaging hook for easily and securely closing. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
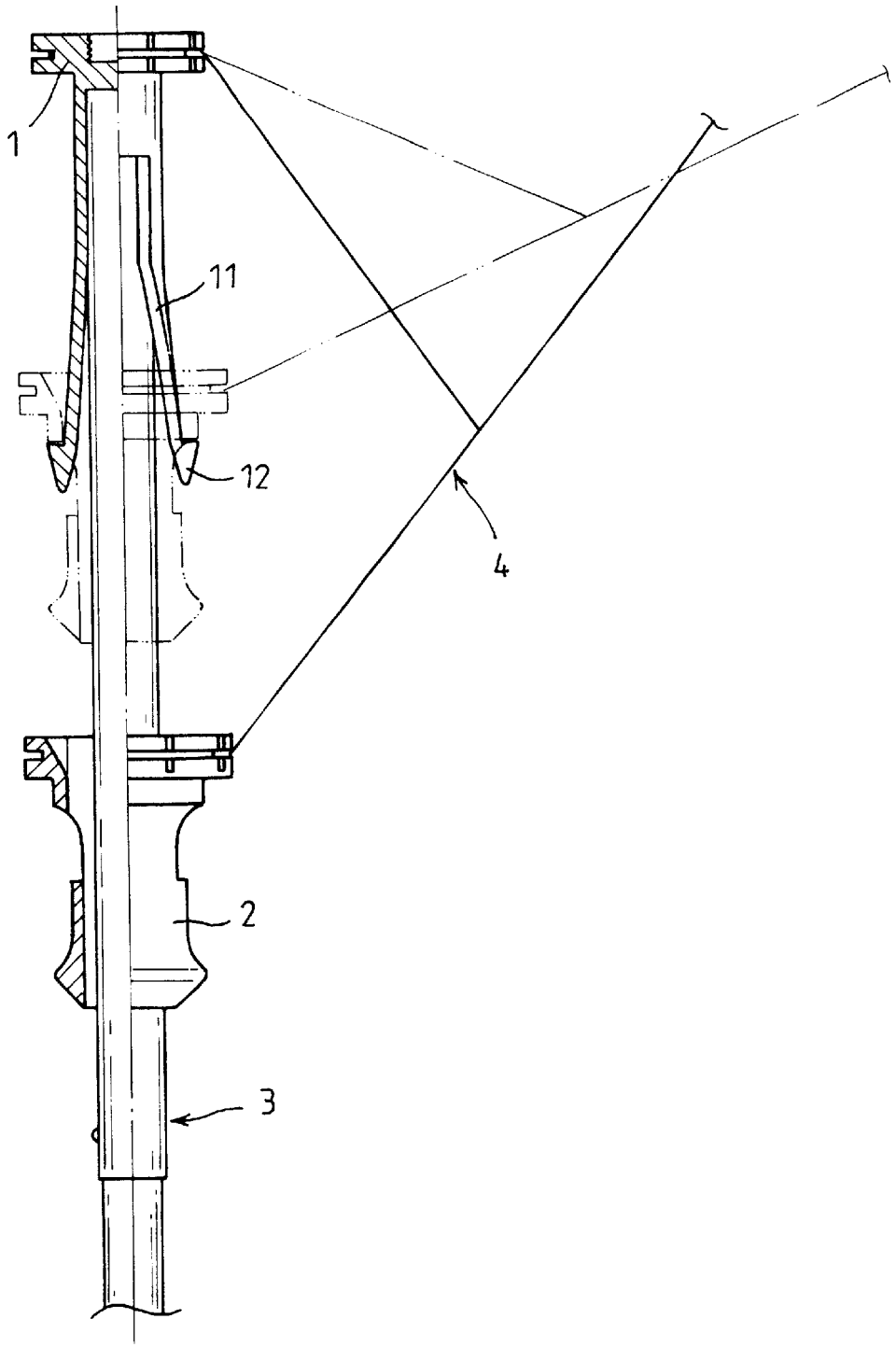
FIG. 1 (prior art)
FIG. 1 is a partly cross-sectional plan view showing a manual folded umbrella of a prior art structure.
Figure 2:
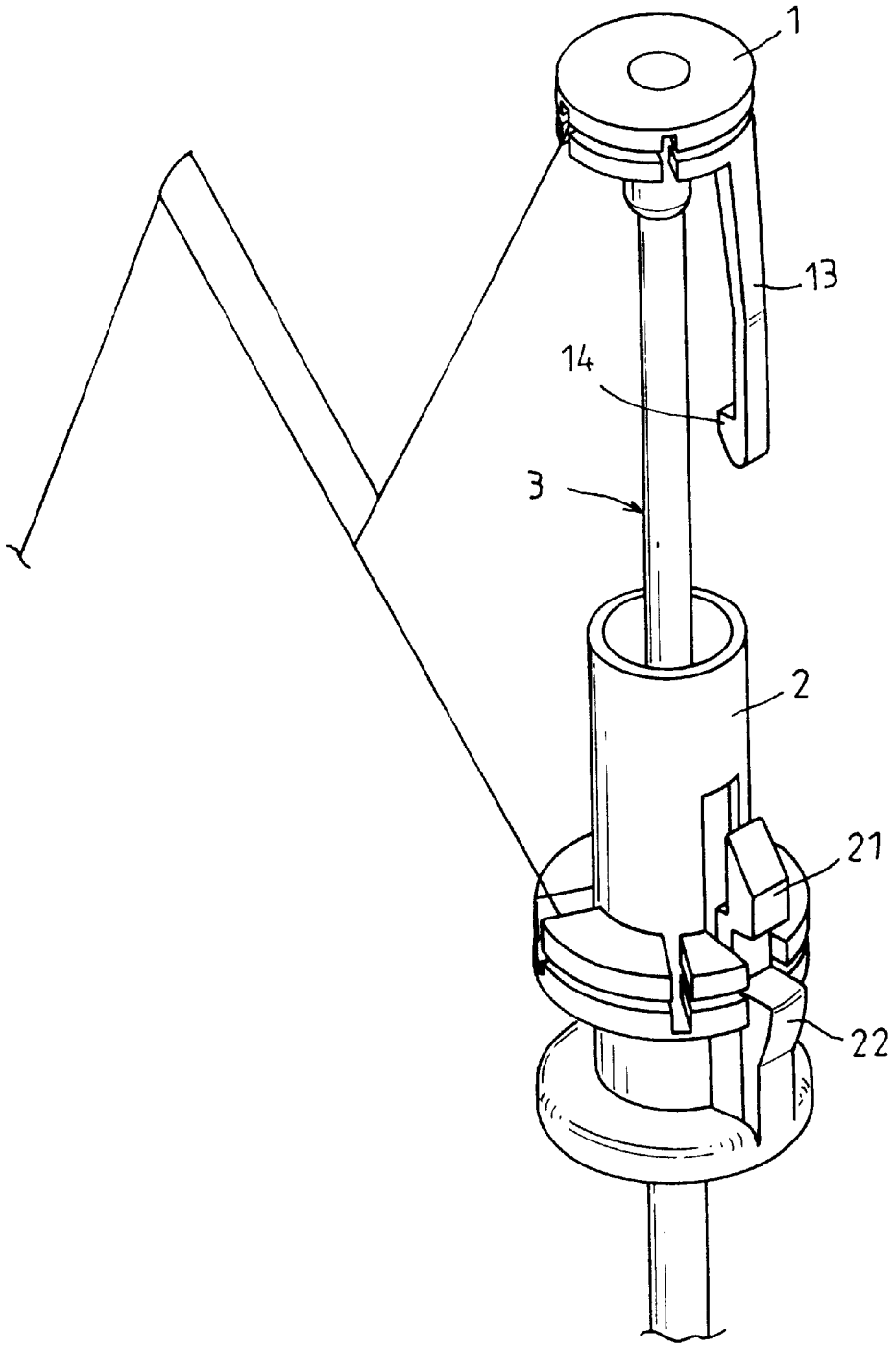
FIG. 2 is a perspective view showing a positioning structure of a manual folded umbrella according to the present invention.
Figure 3:
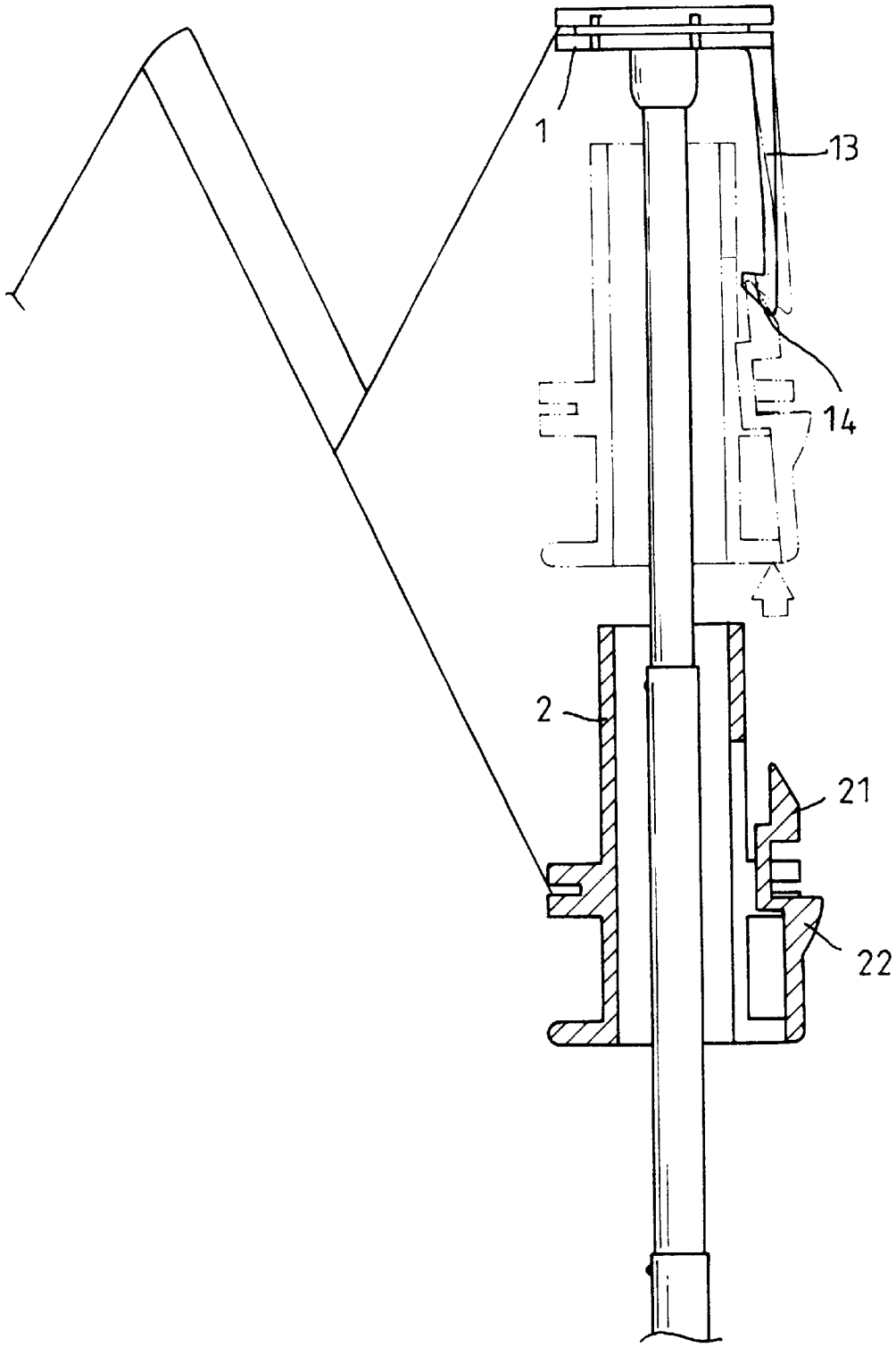
FIG. 3 is a partly cross-sectional plan view of FIG. 2.
Figure 4:
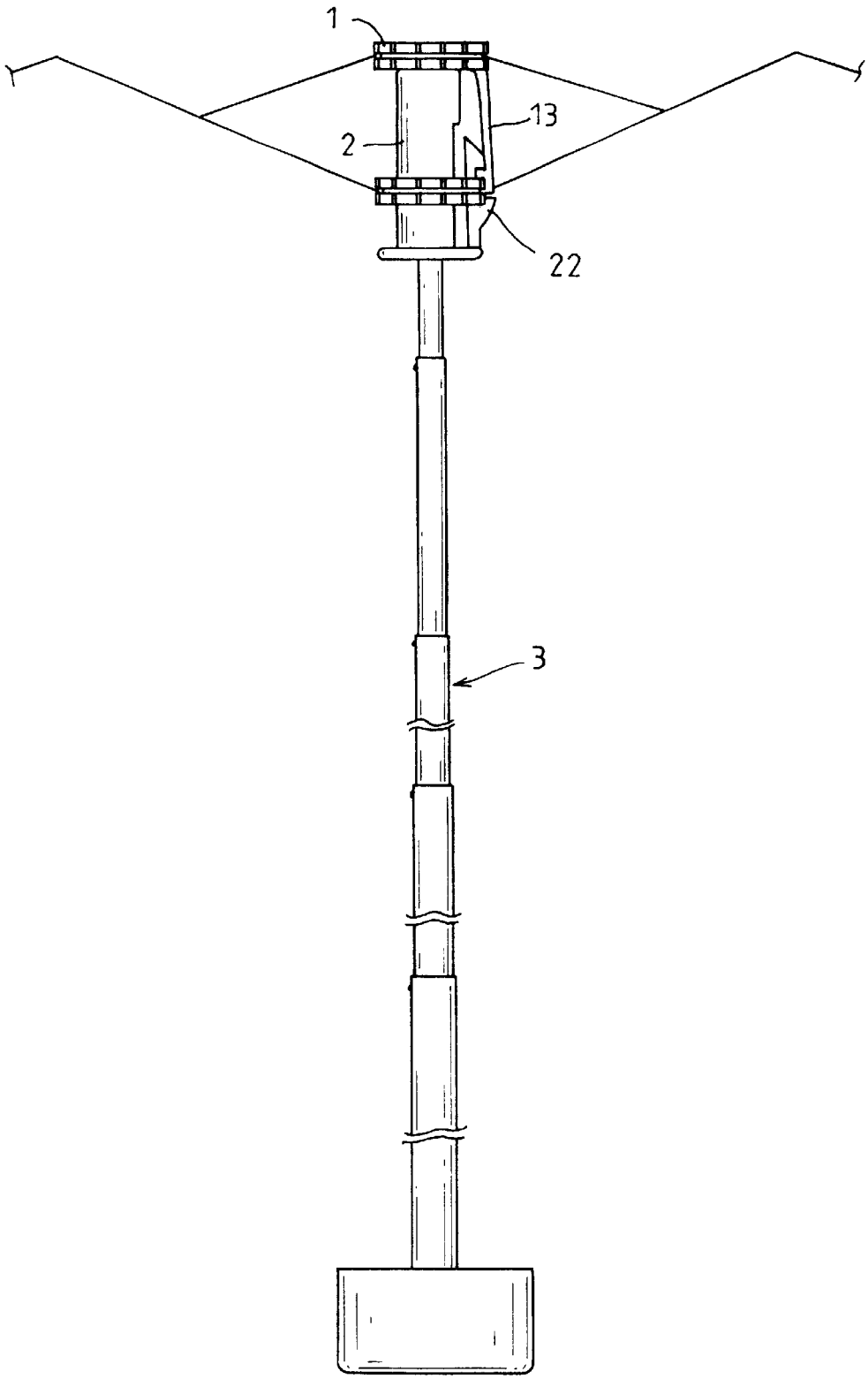
FIG. 4 is a plan view showing the umbrella is opened and is positioned according to the present invention.

Please refer to FIGS. 2 to 4, the present invention relates to a positioning structure of a manual folded umbrella, and particularly to the umbrella having a shaft (3) with large upper tubes and small lower tube. An engaging hook (13) is provided under an upper joint (1) and is formed with an inward step (14) at its bottom end. An elastic connector (21) having a lower projection (22) is provided at a side of a runner (2). When the umbrella is opened, the step (14) of the engaging hook (13) can engage with the elastic connector (21). This engaging hook (13) according to the present invention can be shorter than the prior is due to the design of inward engagement. The engaging hook (13) can increase the strength and then prevent from damage.

Figure 5:
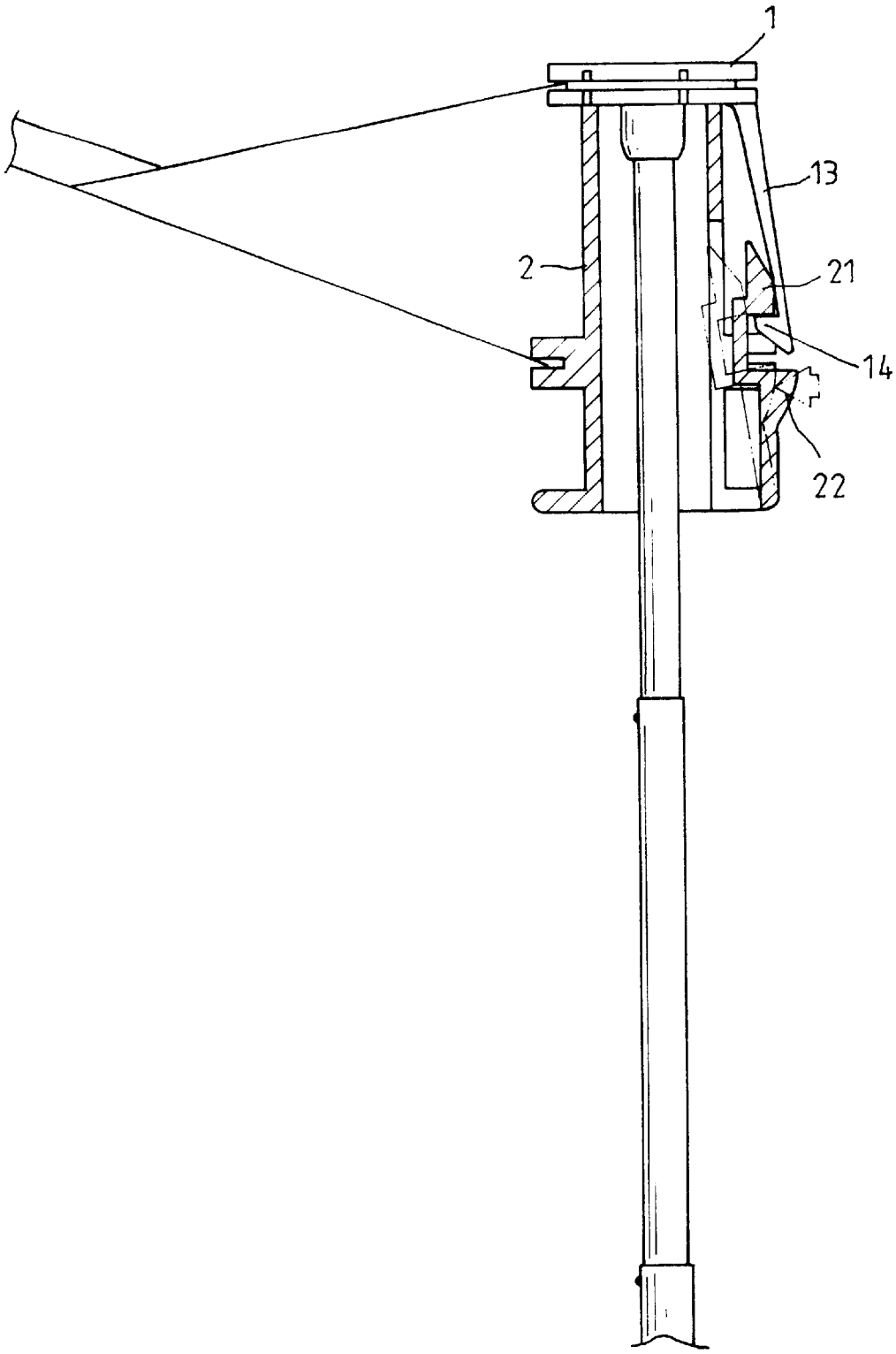
FIG. 5 is a partly cross-sectional plan view showing the umbrella is to be closed according to the present invention.

As shown in FIG. 5, when to close the umbrella, user can just press the projection (14) to push the connector (13) moving inward and departing from the runner (2). The runner (2) can be moved downward for closing the umbrella easily and safely.

Accordingly, the present invention provides an invented structure with improved utility. It obviously gains the utility and novelty for patent and is thus applied.

What is claimed is:

1. A positioning structure of a manual folded umbrella including an engaging hook connected under an upper joint and formed with an inward step at bottom end, and a runner having an elastic connector with a lower projection at a side; the inward step can engage with the connector for positioning the umbrella in opening state and the projection can be pressed to release the runner for closing the umbrella easily and safely.

* * * * *